US006688593B1

(12) United States Patent
Auerbach

(10) Patent No.: US 6,688,593 B1
(45) Date of Patent: Feb. 10, 2004

(54) ENVELOPE TRANSPORT TURN MODULE AND RAMP FOR AN OUTPUT PORTION OF AN INSERTER SYSTEM

(75) Inventor: David R Auerbach, West Redding, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/209,019

(22) Filed: Jul. 31, 2002

(51) Int. Cl.[7] ..... B65H 29/00

(52) U.S. Cl. ..... 271/184; 271/185; 271/225; 209/900; 209/584

(58) Field of Search ..... 271/2, 184, 185, 271/223; 198/403, 406, 407, 412; 209/584, 900

(56) References Cited

U.S. PATENT DOCUMENTS

| | | | | | |
|---|---|---|---|---|---|
| 2,961,085 | A | * | 11/1960 | Stovall | 198/382 |
| 4,012,033 | A | * | 3/1977 | Parrish, II | 271/302 |
| 4,022,712 | A | * | 5/1977 | Noack | 252/389.53 |
| 4,618,136 | A | * | 10/1986 | Pessina et al. | 271/150 |
| 5,119,954 | A | * | 6/1992 | Svyatsky et al. | 209/584 |
| 5,180,154 | A | | 1/1993 | Malick | 271/2 |
| 5,180,159 | A | | 1/1993 | Malick | 271/225 |
| 5,368,287 | A | | 11/1994 | Belec | 271/185 |
| 5,411,250 | A | | 5/1995 | Belec et al. | 271/185 |
| 5,415,385 | A | * | 5/1995 | Newsome et al. | 270/58.25 |
| 5,421,464 | A | * | 6/1995 | Gillmann et al. | 209/584 |
| 5,429,249 | A | | 7/1995 | Belec et al. | 209/584 |
| 5,449,159 | A | | 9/1995 | Belec et al. | 271/2 |
| 5,538,239 | A | | 7/1996 | Auerbach et al. | 271/225 |
| 5,582,087 | A | * | 12/1996 | Crowley et al. | 83/155 |
| 5,583,663 | A | * | 12/1996 | Boeve | 358/487 |
| 5,960,963 | A | | 10/1999 | Chodack et al. | 209/657 |
| 5,971,161 | A | | 10/1999 | Branecky et al. | 209/657 |
| 6,102,391 | A | | 8/2000 | Malick et al. | 271/225 |
| 6,389,327 | B1 | * | 5/2002 | Thiel | 700/227 |
| 6,533,266 | B1 | * | 3/2003 | Schererz et al. | 271/225 |
| 2002/0070149 | A1 | * | 6/2002 | Schererz et al. | 209/540 |

* cited by examiner

*Primary Examiner*—Donald P. Walsh
*Assistant Examiner*—Kaitlin Joerger
(74) *Attorney, Agent, or Firm*—Michael J. Cummings; Charles R. Malandra, Jr.; Angelo N. Chaclas

(57) ABSTRACT

An apparatus and method for changing the orientation, height and direction of envelopes conveyed in an inserter system. The invention reorienting horizontally transported envelopes to a vertical position. The envelopes then being transported around a turning arrangement comprised of a length of driven belt urged against a large diameter idler wheel. A turning guide serves to aid the envelopes through the turning arrangement. A ramp module comprised of nips having toroidal outer circumferences elevate the vertical envelopes. The envelopes finally are turned 180 degrees to be sorted into sorting bins. The overall arrangement of the invention results in an output sub-system of an inserter system with a shortened footprint and ergonomically desirable layout. Also, features of the invention provide that envelopes avoid damage and jamming and that recently closed envelope flaps do not inadvertently open.

31 Claims, 5 Drawing Sheets

ENVELOPE TRANSPORT TURN MODULE AND RAMP FOR AN OUTPUT PORTION OF AN INSERTER SYSTEM

TECHNICAL FIELD

The present invention relates to a device for processing and transporting envelopes, typically in a mail processing system. The device re-orients and redirects the envelopes in preparation for further processing, and achieves an inserter system having a desirable footprint.

BACKGROUND OF THE INVENTION

Inserter systems such as those applicable for use with the present invention, are typically used by organizations such as banks, insurance companies and utility companies for producing a large volume of specific mailings where the contents of each mail item are directed to a particular addressee. Also, other organizations, such as direct mailers, use inserters for producing a large volume of generic mailings where the contents of each mail item are substantially identical for each addressee. Examples of such inserter systems are the 8 series and 9 series inserter systems available from Pitney Bowes Inc. of Stamford Conn.

In many respects, the typical inserter system resembles a manufacturing assembly line. Sheets and other raw materials (other sheets, enclosures, and envelopes) enter the inserter system as inputs. A plurality of different modules in the inserter system work cooperatively to process the sheets to produce a finished mail piece. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

In designing a mail processing system, as described above, it is important to take into consideration various space and ergonomic considerations. A first consideration is the size of a room for housing the inserting system. While an inserting system that has a straight processing path might often be efficient, the number and size of the processing modules might be such that the customer does not have enough room in their facility to accommodate the length in a single dimension. Accordingly, it is known in the art that it may be necessary to provide a turning module, typically at a right angle, to shorten the system's length in any one dimension. The choice or the nature and location of the turning module may be difficult, because turning may introduce additional complexity and error into the system. It is also preferable that a turning module be made to do something useful during the turning process, and that floor space and machinery not be used solely for changing the direction of the processing path.

Another consideration in assembling a mail processing system is ergonomics. Even if a customer has room for a straight system, the distance between the beginning and the end of the system might be so great as to make it difficult for an operator to effectively attend to the whole machine. Accordingly, right angle turn modules have been found to be advantageous to create "L" shaped or "U" shaped arrangements to create a work area in which operators have easier access to all of the modules.

Another ergonomic consideration is the height of various components and transports in the system. In the modules where inserts are being fed into collations of documents, operators must have access to feeders in order to refill them and to correct jams. As such, the feeders are typically placed at a level for attendants' hands to have easy access. As a result, the transport and collations of documents are somewhat below. At an output sorting station, stacks of finished mail pieces are sorted into bins according to zip codes and postal regulations. The sorting bins are periodically hand unloaded by operators. Thus, the bins are typically placed at hand working level. As such, collations and envelopes that are processed upstream, below hand level, must elevated before the sorting stage and sorting bins.

Current mail processing machines are often required to process up to 18,000 pieces of mail an hour, and envelopes travel at speeds as high as 100 inches per second as they are being processed. The steps of moistening and sealing the envelope flaps in particular may result in problems at those speeds. Envelopes may be moving so fast that glue on a moistened envelope flap may not have time form a seal before it is subjected to further processing. Such further processing may cause the envelope flap to reopen partially or fully before the proper sealing can occur. In addition to making the envelope unsuitable for mailing, re-opened flaps can cause jamming of the system.

At such high speeds it is also important to maintain envelopes in their appropriate orientations so that they may be properly handled when they arrive at their respective processing stations. Similarly, it is important to maintain an appropriate gap between subsequent envelopes so that they do not catch up to one another and cause jams. At higher speeds, the mail processing systems become much less tolerant of orientation and spacing errors that can result in jamming and damage to mail pieces.

SUMMARY OF THE INVENTION

The present invention provides an apparatus for changing the orientation, height and direction of envelopes conveyed in an inserter system. In the preferred embodiment, the present invention is used just before an output sorting module of an inserter system. Using this preferred embodiment, the sorting bins of the sorting module can be positioned ninety degrees from the collating and inserting part of the inserting system. This arrangement provides the benefits of a smaller footprint in the longest direction, and the sorting bins are closer to other portions of the main body of the inserter system for operator convenience.

The method and operation of the apparatus in accordance with the present invention starts with the envelopes being transported horizontally in a first direction. Next, the envelopes are reoriented from the horizontal position to a vertical position as they are transported in the first direction. Typically, such reorientation is provided by a twisted belt transport arrangement.

Once the envelopes are placed in the vertical orientation, they are redirected in a second direction perpendicular to the first direction. In the preferred embodiment of the apparatus, this redirecting is achieved by a transport path formed by a vertical belt urged against an outer radius of a relatively large diameter wheel. Transported envelopes are gripped between the belt and the outer radius of the wheel as it is transported through the preferred ninety degree turn. To help guide this turn, the apparatus preferably includes a turn guide comprised of a stationary curved surface extending upward on the interior portion of the turn radius. The turn guide serves to support and guide the envelope as it passes through the turn. The turning guide may also preferably serve to house and support sensors for detecting the position of envelopes as they pass through the turn. Such sensors could not otherwise be housed or supported by the moving wheels or belts that comprise the turning arrangement. In the preferred embodiment, the sensors are supported from above the turning guide, one positioned within the turning guide and the other on the opposite side of the transport path.

After envelopes have passed through the turning arrangement, in the preferred embodiment, the envelopes are raised several inches by transporting them along a ramped vertical transport. Once the envelopes are raised to their desired elevation, they are then redirected by 180 degrees in preparation for being sorted into the sorting bins. This 180 degree redirection is such that the envelopes are being transported back towards the main body of the inserter system as they are being sorted. This configuration may also allow the module housing the turning arrangement to support an outsort bin at the very end of the sorting module. The outsort bin receives outsorted mail pieces rejected, or bypassed from the sorting bins for any of a variety of reasons.

Using the preferred arrangement according to the present invention, operators can have access to the output sorting module while it is perpendicular and proximal to the other stations in inserter system. Also, in this preferred embodiment the output bins have been raised to a level that is more ergonomically appropriate for the operator access.

In a further preferred embodiment, the process of raising the envelopes on a ramp further comprises providing transitions between ramped and flat portions of a transport to allow the envelopes to pivot and to remain substantially in square alignment with a surface of the transport while traveling up the ramp and after leaving the ramp. Such transitions are preferably provided by sets of nips whereby at least one of the nips in each of the transitioning modules is an idler roller having a toroidal outer surface biased against another driven roller. The toroidal idler roller can serve to provide the grip to drive the envelopes, but also allows a pivoting motion so that the envelope maintains its registration while traveling up the ramp.

Another preferred embodiment of the present invention provides that the turning module, having the twisted belt and redirecting mechanism, can be adjusted to receive and transport different size envelopes to be used in the inserter system.

In an alternative embodiment of the present invention, the step of elevating the envelope may take place before it is turned from a horizontal to a vertical orientation. In this arrangement the horizontal envelope can be raised using a conventional horizontal ramp transport, and then the turning arrangement can be utilized to achieve the ninety degree turn to achieve the desired spacing and ergonomic results.

Further features and preferred embodiments are described in the specification, claims, and figures.

DETAILED DESCRIPTION

This patent application is related to co-pending application ser. No. 10/209,016 titled Flat Article Transport and Aligner System, filed currently herewith.

The present invention is preferably used to provide a right angle turn prior to an output sorting module at the end of a high speed mail processing inserter system. Examples of suitable mail piece sorting modules are described in U.S. Pat. Nos. 5,971,161, 5,960,963, 5,449,159, 5,429,249, 5,411,250 and 5,368,287, assigned to the assignee of the present application, each of which is hereby incorporated by reference.

Figure 1:
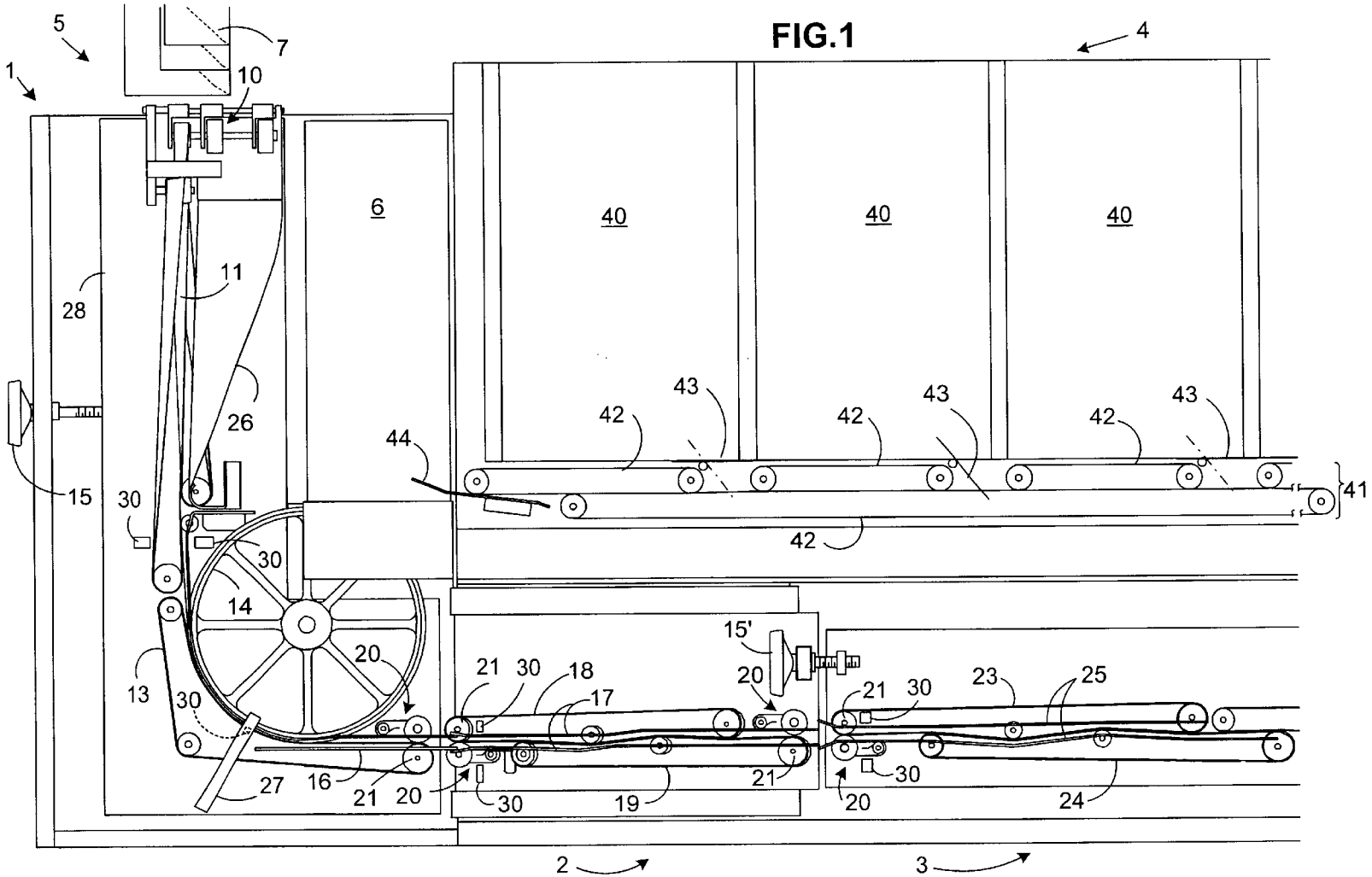
FIG. 1 is a top view of an apparatus in accordance with the present invention.
Figure 2:
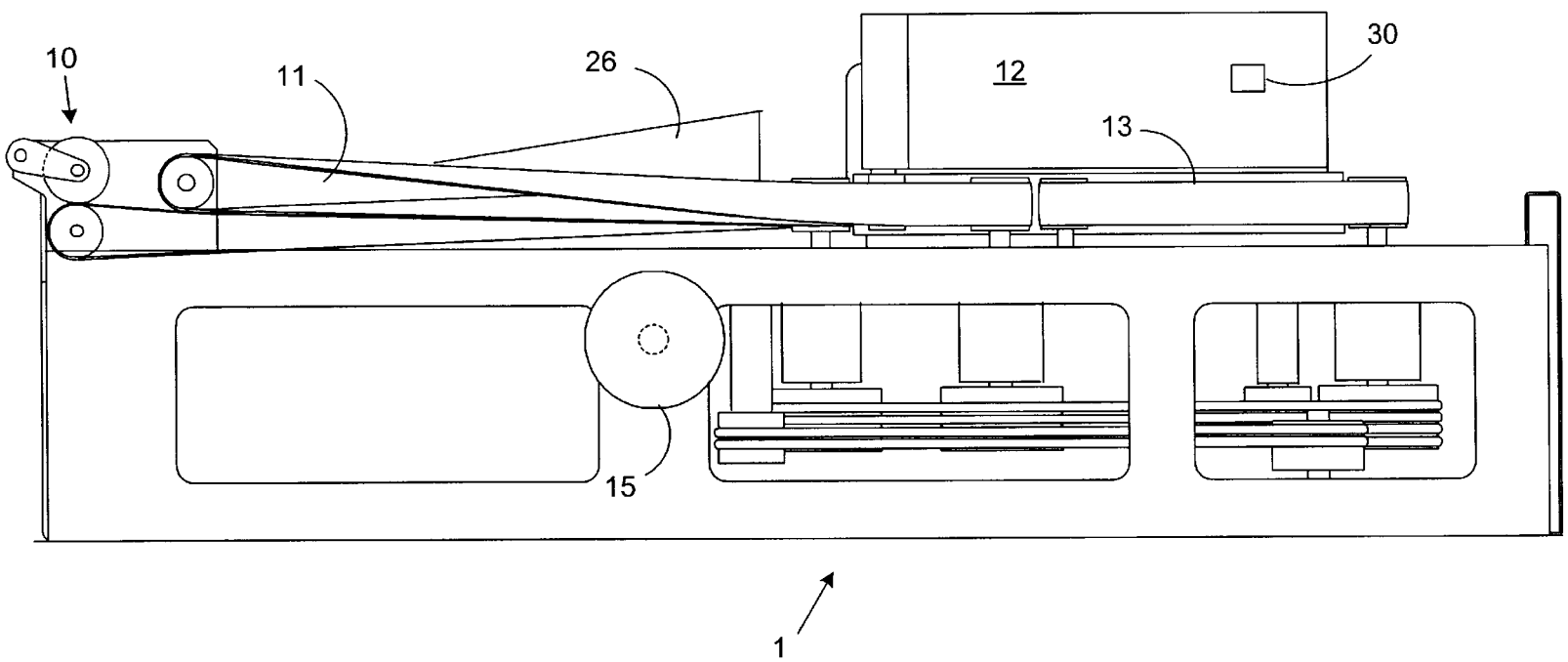
FIG. 2 is a front view of the apparatus in accordance with the present invention.
Figure 3:
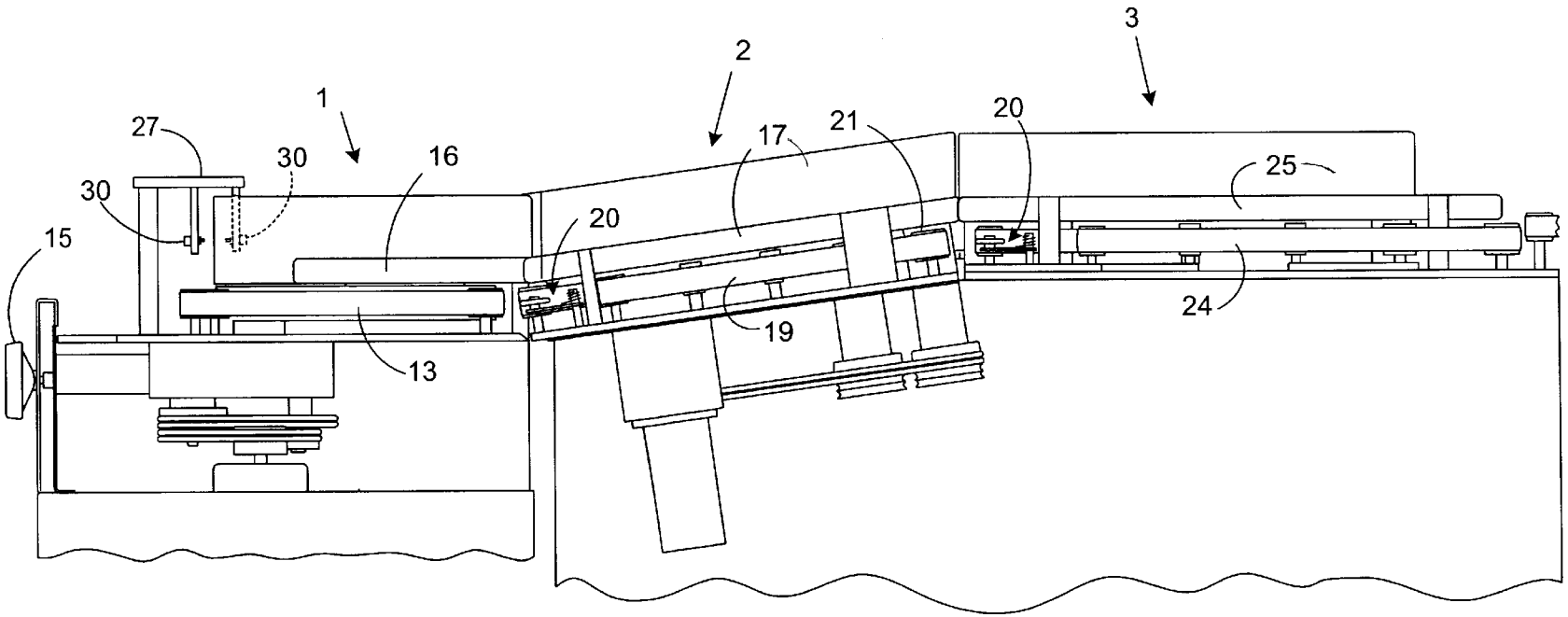
FIG. 3 is a side view of the apparatus in accordance with the present invention.

Referring to FIGS. 1, 2 and 3 components and features of an exemplary embodiment of the present invention may be observed. Major modules of the system comprise a ninety degree turn module 1, a ramp module 2, a 180 degree transport module 3, and a sorting module 4.

The turn module 1, receives envelopes 7 from an upstream module transport 5. The envelopes 7 are received in a horizontal orientation, with the face of the envelope up, and the flap side of the envelope down. Typically, the turn module 1 will be receiving envelopes that have just recently had their flaps closed and moistened for sealing. Because the system operates so quickly, it is unlikely that the moistened flap will have had time to dry and a complete seal will not be formed. Accordingly, certain features in the preferred embodiment are designed to perform the necessary reorienting and redirecting of the envelope without causing the moistened envelope flaps to pop open and to cause jams.

The envelopes 7 are received into turn module 1 via input rollers 10. From the input rollers 10, the envelopes are transferred to input nips for a twisted belt pair 11. Twisted belt pairs are transport mechanisms known in the art for transporting and reorienting envelopes from a horizontal to a vertical orientation (or vice versa).

The twisted belt pair 11 will grip the transported envelopes along a bottom portion of the envelope, so as not to interfere with the flap of the envelope. As the envelopes are transported by the twisted belt pair 11, a torsion force is applied to change the orientation from horizontal to vertical, and to bring the envelope into an upright position. While traveling in the twisted belt pair 11, an upper portion of the envelope may receive guiding and support from a horizontal-to-vertical guide 26. Guide 26 may comprise a guide bar or a piece of twisted material that runs parallel the transport path of the twisted belt pair 11. The guide 26 may serve to assist in keeping the envelope flaps shut during the stress of reorienting the envelope.

In order that the twisted belt pair 11 can properly grip the bottom portions of envelopes of varying sizes, the input end of the twisted belt pair may be adjusted in a direction perpendicular to the transport path, as will be discussed in more detail below.

At a downstream end of the twisted belt pair 11, the vertically oriented envelopes enter a turning arrangement. The turning arrangement preferably transports the envelopes in a new direction perpendicular to their original direction. In the preferred embodiment, the transport for the turning arrangement is driven by turn belt 13. A length of turn belt 13 is positioned such that it is urged against a portion of the circumference of turn wheel 14, positioned contiguous with the transport path. In the preferred embodiment, turn wheel 14 is an idler roller that is turned by the force of the length of the driven turn belt 13 that is pressed against the portion of its circumference. Vertically oriented envelopes received by the turning arrangement are gripped between the turn belt 13 and the turn wheel 14 as it is transported around ninety degrees of the circumference of the turn wheel 14.

Turn belt 13 and turn wheel 14 are preferably of approximate equal height, sufficient to grip a lower portion of the envelope between them, preferably between one and two inches high. By gripping just a lower portion of the envelope, turn belt 13 and turn wheel 14 do not place direct bending strain on the envelope flap as the envelope makes the turn. However, the necessary transport force is provided to move the envelopes through the module.

As the envelopes make the change of direction in the turning arrangement, the preferred embodiment of the present invention utilizes a turning guide 12. The turning guide 12 is comprised of a smooth curved surface extending vertically upward along the side of the transport path interior to the turn radius of the transport path formed by belt 13 and wheel 14. A portion of turning guide 12 disposed above the interface of belt 13 and wheel 14 provides support to for the upper portion of envelopes passing through the turn. Such vertical support helps to prevent bending or distortion of the envelopes that might occur while being gripped and turned by the forces acting upon their lower portions. Also, the support provided by turn guide 12 keeps the envelope flaps closed to aid in proper sealing. In the preferred embodiment, the radius of the curved portion of the turning guide 12 is just slightly less than the radius of the wheel 14.

In the present invention, wheel 14, having a relatively low height compared to the envelopes, is more desirable than a taller drum that might be similarly situated for the purpose of providing turning. A first advantage of the wheel 14 over a drum is that the wheel is easier and cheaper to manufacture than a drum, in part because it is smaller and may be composed of less expensive and more easily manufactured parts. Another advantage is that the wheel, again being smaller, weighs less and has less inertia. Having less inertia, the wheel 14 can start and stop more quickly. The ability to start and stop more quickly provides greater precision in the system, and may allow the system to come to a stop more quickly upon the occurrence of an error condition, like jamming.

Figure 5:
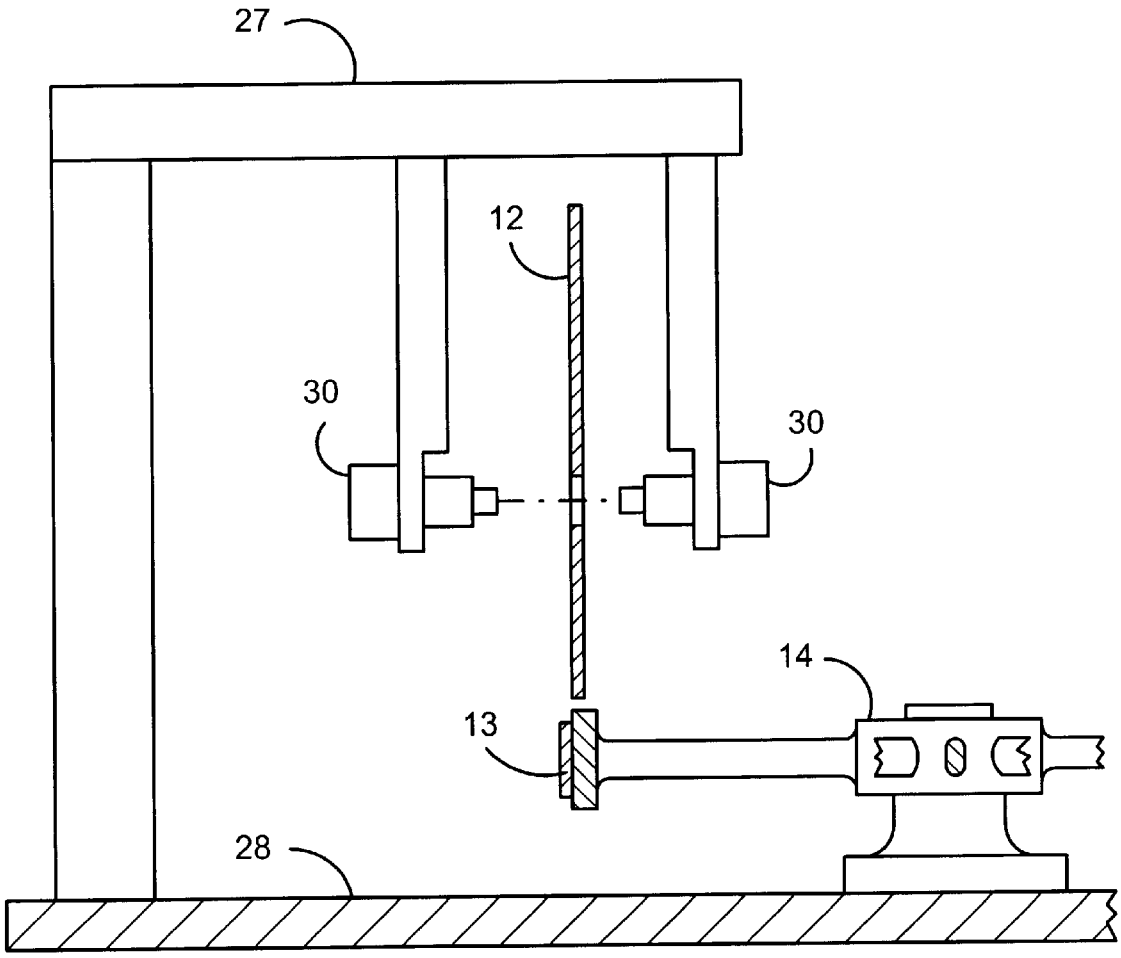
FIG. 5 is a sensor arrangement for detecting envelopes traveling within the turning portion of the turning module of the present invention.

Another advantage of the wheel 14 and turn guide 12 arrangement is that the stationary turn guide can provide a support platform for position sensors 30 to detect the position of envelopes passing within the turning arrangement. If a drum is used, it would be very difficult to arrange a sensor on the moving drum to reliably detect envelopes as they pass through. In the preferred embodiment, shown in FIG. 5, sensors 30 are supported above the belt 13 and wheel 14 on sensor base 27. One sensor 30 is supported inside the curve of the turning guide 12, while its corresponding mate is supported oppositely outside of the turning guide 12. A small hole is provided in turning guide 12 between the pair of sensors 30 so that when an envelope disrupts the optical connection between the sensors, it is known that an envelope has reached that position in the transport path. Thus, envelopes are detected as they pass along the surface of turn guide 12, breaking the path between the position sensors (preferably optical sensors). The turn guide 12 and wheel 14 combination allows all of these advantages without any loss of functionality in comparison to an arrangement using a drum.

After the envelopes have completed their change of direction in the turning arrangement, they continue to be transported in the vertical position by series of rollers and belts. Above the rollers an belts, the envelopes receive support from transport guides 16 and 17, which continue the guiding function in holding the envelopes upright, and providing support for the envelope flaps.

Shortly upon leaving the turning arrangement, the envelopes are transferred from turn module 1 to the ramp module 2. The purpose of ramp module 2 is to raise the envelopes from a lower elevation, at which they were processed earlier in the system, to a higher elevation used by the output sorting module 4. There is no mechanical requirement that the output sorting process occur at a higher elevation than earlier processing. However, since the sorting includes bins 40 that have a downward slant, and because upstream automated processing generally occurs at a level lower than a comfortable working level for human workers, it is desirable from an ergonomics perspective to raise the envelopes for the output sorting stage. Typically the envelopes may be raised by a height of two or three inches. For such elevation changes, the ramp module 2 is preferably inclined at an angle of approximately eight degrees.

The input and output portions of the transports for the turn module 1 and the ramp module 2 have particular configurations of rollers and belts to maintain the registration of the bottom of the envelopes substantially parallel to the path of travel, even on the ramp and after the ramp. This is desirable so that envelopes do not become too tilted relative to the travel direction. Downstream, such tilting may have the effect of causing jams as the envelopes are processed by the sorting mechanisms.

For much of the length of the ramp module 2 the envelope is transported between belts 18 and 19, with an upper portion of the envelope guided by guides 17. Similarly for an initial linear portion of transport module 3 the envelope is transported between belts 23 and 24, with an upper portion of the envelope guided by guides 25. The transport guide pairs 17 and 25 may be comprised of guides that are different heights on the opposite sides of the feed path. In the preferred embodiment, an interior guide 17 or 25, of a pair is taller, and has a height substantially the same as the turning guide 12. The taller guide provides support on the flap side of transported envelopes for continued prevention of opening of the flap before a seal can be formed.

In transferring envelopes from the turning module 1 to the ramp module 2, and from the ramp module 2 to the transport module 3, alignment of the envelopes with the transport path is maintained by specially designed sets of nips comprised of rollers 20 and 21 at the interface of those transports. Roller 21 may be a driven roller at the transition end of a transport belt 13, 18, 19, or 23, as shown in FIG. 1. Roller 21 is driven along with its respective transport belt.

Figure 4A:
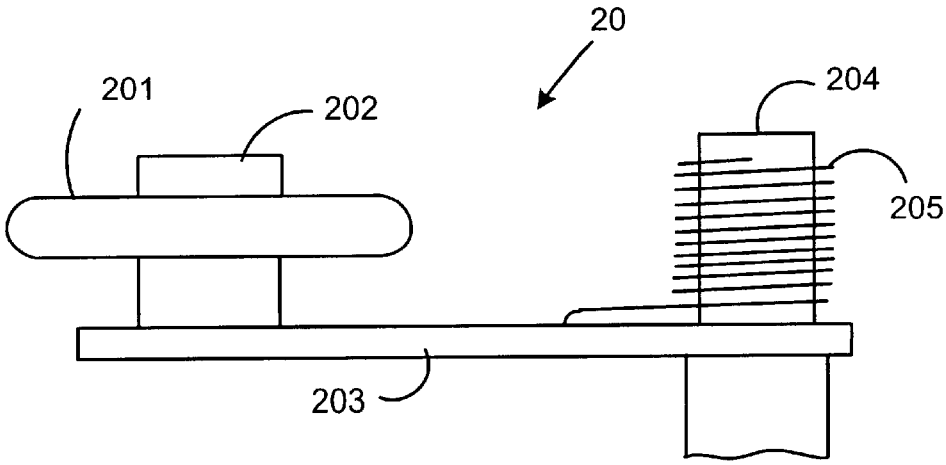
FIGS. 4*a* and 4*b* are a side and top view of a toroidal idler roller for use with a preferred embodiment of the present invention.
Figure 4B:
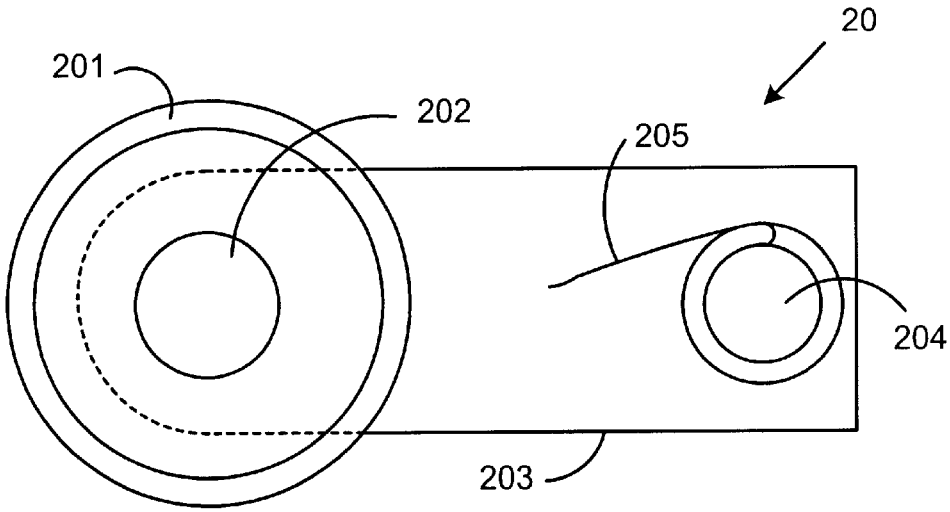

Opposite roller 21 is idler roller assembly 20, the preferred embodiment of which is depicted in FIG. 4. The idler roller assembly is comprised of a toroidal roller wheel 201 rotatably mounted on a shaft 202 mounted on an arm 203. Arm 203 pivots on base shaft 204. The toroidal wheel 201 is spring biased against roller 21 by the spring 205 providing angular tension between the arm 203 and the base shaft 204.

The toroidal shape of the wheel 201 results in a relatively small point of contact between the toroidal wheel 201 and the driven roller 21. The small point of contact on the curved outer diameter of the toriodal wheel 201 provides a moving pivot point around which the envelope may turn as the transport direction changes. Thus when a forward portion of an envelope driven between roller 21 and idler roller 20 is pulled in a direction with an angular vector different than its current direction, the envelope can pivot at the point between those rollers to adjust to the new vector while it continues to be driven forward with the same forward vector. To reduce frictional forces on envelopes between rollers 20 and 21 even more, in a preferred embodiment, the driven roller 21 may also have a somewhat curved outer surface to further reduce the friction creating surface area of the nip rollers on the envelope.

In practice, as an envelope reaches the output of turn module 1, the first set of nips 20 and 21 at that location are in a horizontal orientation and will continue to drive the envelope in the horizontal direction. However, when the lead edge of the envelope reaches the angled set of second nips 20 and 21 at the beginning of ramp module 2, then the lead edge of the envelope is urged upward in the angled direction. The envelope pivots upward at both the first and second set of nips as control is transferred to the ramped transport system and belts 18 and 19. Once the envelope comes under the full control of ramp module 2 the envelope has pivoted such that it is angled at substantially the same direction as the ramped transport direction.

The same process occurs in reverse as the envelope changes from an angled direction of travel to once again traveling in a horizontal direction at the transition from ramp module 2 to horizontal transport module 3.

If the first set of nips were conventional rollers with flat surfaces, the frictional forces of the nips during a transition to or from ramp module 2 would prevent pivoting. As a result, conflicting vector forces acting on the envelope could cause it to buckle and/or jam. Even if slippage in the nips prevents damage to the envelopes, when the envelope comes under the full control of the ramp transport 3, it will no longer be oriented squarely in the transport direction. This is the situation which is avoided with the preferred embodiment of the present invention. An envelope that is too far askew in the transport cannot be properly processed by sorting module 4.

In a preferred embodiment, an apparatus utilizing the present invention can be adjusted to receive and process envelopes of different sizes. A first location that is sensitive to different envelope sizes is the input rollers 10 at the input to turn module 1. As discussed previously, the twisted belt pair 11, and other downstream vertical transport devices grip a lower portion of the envelopes. Because the envelopes 7 typically arrive at the turn module 1 with their top edges registered along a common border, variance in the sizes of the envelopes results in different locations for their lower portions relative to the turn module 1. Accordingly, as can be seen in FIG. 1, it is desirable that the input rollers 10, and the corresponding beginning of the twisted belt pair be adjustable laterally to the transport direction of the envelopes. Such adjustment would typically only be necessary when starting a new mail production job using different sized envelopes.

As seen in FIG. 1, the input rollers 10 and twisted belt pair 11 are mounted on a base 28 which is laterally movable relative to the frame of the turn module 1. The lateral position of the base 28 is adjusted by turning adjusting mechanism 15.In the preferred embodiment, the adjusting mechanism includes a threaded shaft rotatably and fixedly mounted to the frame of turn module 1. When the adjusting mechanism 15 is turned, a screw interface with base 28 causes the base to move a desired amount to a position where the input roller 10 grip the lower portion of the envelopes at the standard predetermined position.

Base 28 also preferably supports the turning arrangement comprised of the wheel 14 and turning belt 13. Thus, simultaneously with adjusting the position of input rollers 10, the same motion can adjust a gap in the transport path between the turn module 1 and ramp module 2. By making the appropriate adjustment, more space will be provided for larger envelopes to make the transition in the turn upward onto ramp module 2.

To allow a similar adjustment to be made at the transition from the ramp module 2 to transport module 3, another adjustment mechanism 15' may be provided between those two modules. In an exemplary embodiment, the adjustment mechanism may again be a threaded turnscrew mechanism, with one end fixedly mounted on ramp module 2 and the other end attached though a threaded interface to a movable base in the transport module 3. In practice, using the preferred embodiment, it has been found that the second adjustment mechanism 15' is not necessary, and that the resulting error in positioning as a result of not adjusting for different envelope sizes is not so great as to affect the downstream sorting process. However for use with different downstream processing, less error may be tolerated, and adjustment mechanism 15' may be necessary.

After the envelopes are (1) reoriented from horizontal to vertical, (2) redirected by ninety degrees, and (3) elevated by several inches, the transport module 3 reverses the direction of the transport path by 180 degrees to perform the sorting process in sorting module 4. Sorting module 4 is located to the side of ramp module 2 and transport module 3 that is closer to the inserter system modules upstream of the turn module 1. In this way an inserter system with an "L" or "U" shaped footprint can be formed, with the interior of the "L" or "U" serving as the workspace for operators. Workers may attend to upstream modules while being able to observe the operation of the sorting module 4. Also, when it comes time to empty the bins 40 of the stacks of processed mail, the operators may perform that task without having to walk too far from the other stations on the inserter machine.

During the sorting process envelopes are transported on the sort transport 41 comprised of a series of belts 42 between which envelopes are transported. At various intervals in the sort transport 41, deflectors 43 open to deflect the envelopes into the appropriate sort bins 40.

If an envelope cannot be sorted properly into any of the sort bins 40, whether an error has occurred, or special handling is required, it is deposited into an outsort bin 6 at the end of the sort transport 41. An outsort guide 44 guides mail pieces into the outsort bin 6 in an orderly fashion.

A potential advantage of the preferred embodiment depicted in FIG. 1, is that the outsort bin 6 can be mounted in turn module 1. As discussed previously, floor space for inserter systems is often at a premium, and the greater the amount of functionality that can be achieved in a shorter distance, the better. The arrangement depicted in FIG. 1, shows that the turn module 1 can provide space for the outsort bin 6, along the side, and elevated from, the twisted belt pair 11. By placing the outsort bin 6 at that location, the overall length of the sorting module 4 can be shortened, and greater efficiency is achieved and floor space saved.

As an alternative to the arrangement of the modules described above, i.e., with turn module 1 followed by the ramp module 2, a different kind of ramp module may precede turn module 1, and ramp module 2 may be eliminated. In this alternative arrangement, the alternative ramp module is one similar to that depicted as item 10 in FIG. 2 of U.S. Pat. No. 5,971,161, incorporated by reference. The alternative ramp module raises the envelope in a horizontal orientation using conventional transport techniques. The turn module 1 may then reorient and turn the elevated horizontal envelopes by ninety degrees, as described above.

In this alternative embodiment the vertical ramp module 2 after the turn module 1 is not necessary. However, the use of the conventional horizontal envelope ramp may be less desirable for an installation that desires to minimize the length of the system in the first travel direction. The length of the alternative ramp portion will add to the length of the system in the first direction. The preferred embodiment, using ramp module 2 described above, however, may not add any length in any direction as it takes advantage of a length of the sorting module 4 where the system doubles back on itself.

Although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. An apparatus for changing the orientation and direction of envelopes conveyed in a transport path in a mail piece processing system, the apparatus comprising:

an first transport forming an upstream portion of the transport path and transporting envelopes in a first direction in a horizontal orientation;

a twisted belt transport downstream of the first transport, receiving envelopes from the first transport, the twisted belt transport conveying envelopes in the first direction and reorienting the envelopes from the horizontal orientation to an upright vertical orientation;

a turning arrangement downstream of the twisted belt transport, receiving vertically oriented envelopes from the twisted belt transport, the turning arrangement substantially altering the transport path to a second direction, the turning arrangement further comprising;

a horizontal wheel and a vertical belt, a length of the vertical belt being urged against an outer radius surface of the horizontal wheel to cooperatively form the transport path, for gripping a lower portion of vertically oriented envelopes, between the outer radius surface of the wheel and the length of vertical belt; and a turning guide comprising a stationary curved vertical surface located substantially over, the outer radius surface of the horizontal wheel, the surface of the turning guide providing vertical support for an upper portion of vertically oriented envelopes as they move through the turning arrangement; and a sloped ramp-transport receiving the vertically oriented envelopes from the turning arrangement at a first height and transporting the envelopes to an output transport having a second height higher than the first height.

2. The apparatus of claim 1 wherein the turning guide extends over a length of the transport path to guide the upper portion of the vertically oriented envelopes for a portion of the transport path where it changes from the first direction to the second direction.

3. The apparatus of claim 1 further comprising a sensor arrangement located proximally to the turning guide, the sensor detecting the presence of envelopes in the turning arrangement.

4. The apparatus of claim 3 wherein the sensor arrangement comprises a first sensor supported inside an Interior portion of the turning guide, and a second sensor supported in a position facing the first sensor on an opposite side of the transport path, the turning guide including a hole through which the first and second sensor communicate, the first and second sensors providing a position signal when communication between the sensors is broken by an envelope traveling in the transport path.

5. The apparatus of claim 1 further comprising a twisted guide surface proximal, and substantially parallel to, the twisted belt transport, the twisted guide surface guiding a portion of the envelope not within the twisted belt transport.

6. The apparatus of claim 1 further comprising an adjustment mechanism for adjusting a position of the twisted belt transport perpendicular to the first direction for proper positioning to receive envelopes of varying sizes from the horizontal transport.

7. The apparatus of claim 1 wherein the turning arrangement changes the transport path from the first direction to the second direction by an angle that is substantially ninety degrees.

8. The apparatus of claim 1 wherein a radius of the turning guide is slightly less that the radius of the horizontal wheel.

9. The apparatus of claim 1 wherein the twisted belt transport and turning arrangement comprise a right angle turn module, for transporting envelopes to an envelope sorting output module, the envelope sorting output module including a sorting transport having an envelope sorting transport direction opposite to the second direction.

10. The apparatus of claim 9 wherein the right angle turn module further comprises an outsort bin at the end of the envelope sorting transport for receiving envelopes that were not sorted into sorting bins of the envelope sorting output module.

11. The apparatus of claim 1 further comprising:

sets of ramp nips, a set of ramp nips comprises a driven roller and an idler roller with a toroidally shaped outer surface biased against the driven roller, the transport path passing between the driven roller and the idler roller; and wherein a first set of horizontal ramp nips is located at a downstream end of the turning arrangement, a second set of angled ramp nips is located at an upstream end of the ramp transport, the first and second sets of ramp nips cooperating to allow the vertically oriented envelopes to pivot upward in a transport direction having an angle substantially the same as the slope of the ramp transport; and wherein a third set of angled ramp nips is located at a downstream end of the ramp transport, and a fourth set or horizontal ramp nips at an upstream end of the output transport, the third and fourth sets of ramp nips cooperating to allow the vertically oriented envelopes to pivot downward in the transport path in a substantially horizontal travel direction.

12. The apparatus of claim 11 wherein the ramp transport raises the transport path between two and four inches.

13. The apparatus of claim 11 wherein the turning arrangement changes the transport path from the first direction to the second direction by an angle that is substantially ninety degrees.

14. The apparatus of claim 13 wherein the twisted belt and the turning arrangement are mounted on a common base and further comprising an adjustment mechanism for adjusting a position of the base perpendicular to the first direction, and parallel to the second direction, for positioning of the twisted belt transport and for adjusting a gap between the first and second set of ramp nips, so as to account for envelopes of varying sizes to be transported.

15. The apparatus of claim 14 further comprising a second adjustment mechanism for adjusting the distance between the third and fourth sets of ramp nips so as to account for envelops of varying sizes to be transported.

16. The apparatus of claim 1 wherein the twisted belt transport and turning arrangement comprise a right angle turn module for transporting envelopes to an envelope sorting output module, the envelope sorting module including a sorting transport having an envelope sorting transport direction opposite to the second direction, the sorting transport elevated higher than the transport path in the right angle turn module.

17. The apparatus of claim 16 wherein the right angle turn module further comprises an outsort bin at the end of the envelope sorting transport for receiving envelopes that were not sorted Into sorting bins of the envelope sorting output module.

18. An apparatus for changing the orientation and direction of envelopes conveyed in a transport path in a mail piece processing system, the apparatus comprising:

a ramp transport for raising an elevation of transported envelopes as they travel in a first direction in a horizontal orientation;

a twisted belt transport downstream of the ramp transport receiving envelopes from the ramp transport, the twisted belt transport conveying envelopes in the first direction and reorienting the envelopes from the horizontal orientation to an upright vertical orientation;

a turning arrangement downstream of the twisted belt transport, receiving vertically oriented envelopes from the twisted belt transport, the turning arrangement substantially altering the transport path to a second direction, the turning arrangement further comprising:

a horizontal wheel and a vertical belt, a length of the vertical belt being urged against an outer radius surface of the horizontal wheel to cooperatively form the transport path, for gripping a lower portion of vertically oriented envelopes, between the outer radius surface of the wheel and the length of vertical belt; and a turning guide comprising a stationary curved vertical surface located substantially over, the outer radius surface of the horizontal wheel, the surface of the turning guide providing vertical support for an upper portion of vertically oriented envelopes as they move through the turning arrangements;

wherein the twisted belt transport and turning arrangement comprise a right angle turn module for transporting envelopes to an envelope sorting output module, the envelope sorting output module Including a sorting transport having an envelope sorting transport direction opposite to the second direction.

19. The apparatus of claim 18 wherein the turning guide extends over a length of the transport path to guide the upper portion of the vertically oriented envelopes for a portion of the transport path where it changes from the first direction to the second direction.

20. The apparatus of claim 18 further comprising a sensor located proximally to the turning guide, the sensor detecting the presence of envelopes in the turning arrangement.

21. The apparatus of claim 18 wherein the turning arrangement changes the transport path from the first direction to the second direction by an angle that is substantially ninety degrees.

22. The apparatus of claim 18 wherein a radius of the turning guide is slightly less that the radius of the horizontal wheel.

23. The apparatus of claim 18 wherein the right angle turn module further comprises an outsort bin at the end of the envelope sorting transport for receiving envelopes that were not sorted into sorting bins of the envelope sorting output module.

24. A method of handling mail pieces in an inserter system, the method comprising:

transporting envelopes in a horizontal position in a first direction;

reorienting the envelopes from the horizontal position to a vertical position;

redirecting and transporting the vertically oriented envelopes in a second direction substantially perpendicular to the first direction;

raising an elevation of the vertically oriented envelopes by transporting them on a ramp in the second direction;

redirecting and transporting the elevated and vertically oriented envelopes in a third direction that is substantially in the opposite direction as the second direction;

sorting the envelopes into sorting bins as they travel in the third direction.

25. The method of claim 24 wherein the step of raising envelope on the ramp further comprises providing transitions between ramped and flat portions of a transport allowing the envelopes to pivot and to remain substantially in square alignment with a surface of the transport while traveling up the ramp and after leaving the ramp.

26. The method of claim 25 a wherein the step of providing transitions further comprises gripping the envelopes in a pair of nips, at least one of the nips in the pair having a toroidal outer surface.

27. The method of claim 24 further comprising mounting devices for carrying out the steps of reorienting and redirecting to the second direction on a common base, and adjusting the common base perpendicular to the first direction and along the second and third directions to adjust for different size envelopes to be transported.

28. The method of claim 24 wherein the step or redirecting from the second direction to the third direction includes redirecting the envelopes to a side of the ramp that is proximal to upstream processing modules in the inserter system.

29. A method of handling mail pieces in an inserter system, the method comprising:

transporting envelopes in a horizontal position In a first direction;

raising an elevation of the horizontally oriented envelopes by transporting them on a ramp in the first direction;

reorienting the envelopes from the horizontal position to a vertical position;

redirecting and transporting the vertically oriented envelopes in a second direction substantially perpendicular to the first direction;

redirecting and transporting the elevated and vertically oriented envelopes in a third direction that is substantially in the opposite direction as the second direction;

sorting the envelopes into sorting bins as they travel in the third direction.

30. The method of claim 29 further comprising mounting devices for carrying out the steps of reorienting and redirecting to the second direction on a common base, and adjusting the common base perpendicular to the first direction and along the second and third directions to adjust for different size envelopes to be transported.

31. The method of claim 29 wherein the step or redirecting from the second direction to the third direction includes redirecting the envelopes in a path on a side proximal to upstream processing modules in the inserter system, and the step or sorting occurs on the side proximal to the upstream processing modules.

* * * * *